United States Patent [19]

Baker

[11] 4,234,879

[45] Nov. 18, 1980

[54] PLUG-TYPE SWITCH

[75] Inventor: Robert K. Baker, Elvins, Mo.

[73] Assignee: Potter Electric Signal Co., St. Louis, Mo.

[21] Appl. No.: 62,991

[22] Filed: Aug. 2, 1979

[51] Int. Cl.[3] ..... G08B 21/00

[52] U.S. Cl. ..... 340/686; 200/42 R; 340/540; 340/568

[58] Field of Search ..... 340/686, 568, 548, 540; 200/92 R

[56] References Cited

U.S. PATENT DOCUMENTS

| | | | |
|---|---|---|---|
| 3,253,270 | 5/1966 | Donner | 340/568 |
| 3,444,547 | 5/1969 | Surek | 340/568 |
| 3,972,039 | 7/1976 | Marshall | 340/568 |
| 4,003,048 | 1/1977 | Weise | 340/568 |
| 4,118,691 | 10/1978 | Sims | 340/548 |

OTHER PUBLICATIONS

Potter Electric Signal Co., "PTS Plug Type Switch", St. Louis, Mo, Nov. 29, 1960.

*Primary Examiner*—Glen R. Swann, III

[57] ABSTRACT

A plug-type alarm switch for supervision of handwheel water valves and the like has an enclosure having a key-locked cover and containing, wired in series, a two-connector female receptacle and a normally closed enclosure cover tamper switch. The receptacle, otherwise movable within the enclosure, is held in place on being mated through a passage in the enclosure wall to a two-prong male plug, which is shorted by an insulated loop of wire passed through the handwheel. If the handwheel is turned, pulling the loop, the plug and receptacle are unmated, opening the switch circuit and signalling an alarm. The unmated receptacle will not remain aligned with the passage for reinsertion of the plug prongs; to restore the circuit the cover must be unlocked and removed and the receptacle must be physically held in proper alignment as the plug is reinserted.

10 Claims, 1 Drawing Figure

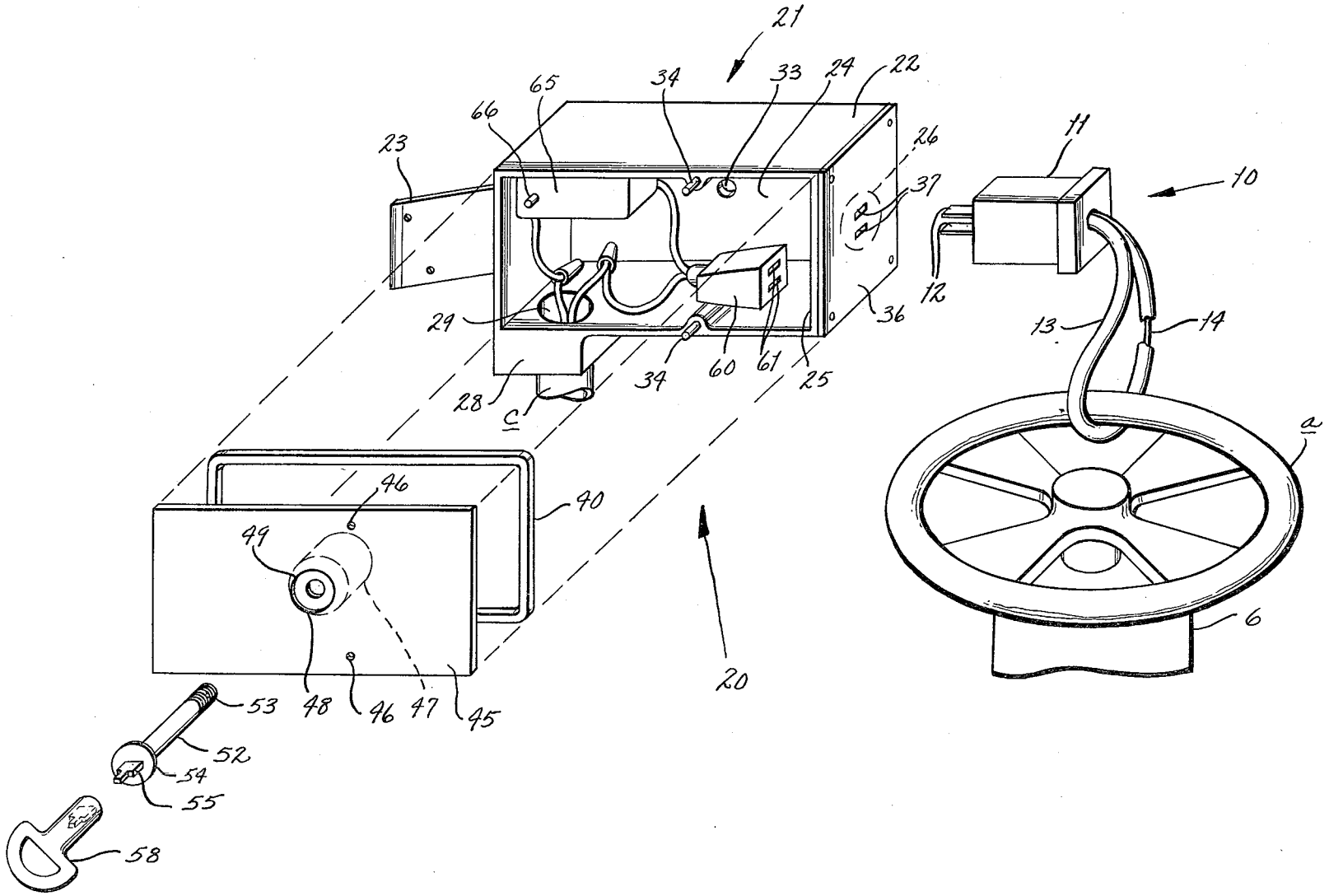
10
11
12
13
14
2
6
21
22
23
24
25
26
28
29
33
34
34
36
37
60
61
65
66
20
40
45
46
46
47
48
49
52
53
54
55
58

PLUG-TYPE SWITCH

BACKGROUND OF THE INVENTION

The present invention relates to alarm systems, particularly to alarm switches of the type which signal tampering with valves or other manual actuators, such as handwheel valves for sprinkler systems.

Often valves in fire sprinkler systems are inadvertently closed by unauthorized persons; if a fire should then occur, the sprinklers do not operate and a fire which might otherwise be easily contained spreads beyond control. To signal unauthorized closing of valves of this type, or the inadvertent failure to reopen after an intended closing, alarm devices known as plug-type switches have been used. In the past these have been relatively complex, having many parts which require special tooling. In one such switch, a male electrical plug has its two electrical connectors shorted by a loop of insulated wire passed through the handwheel valve. The plug prongs are inserted into an adjacent permanently mounted enclosure, in which they engage the inner sides of two inwardly-spring-biased contact fingers, forming a closed switch circuit between terminals on the fingers. If the handwheel is turned, the plug is pulled from its connection within the enclosure by the loop of wire, causing an open circuit, which may be used by other circuitry to sound an alarm. Flanges on the ends of the fingers prevent reinsertion of the plug except by an authorized person who spreads the fingers by a key-actuated pushrod mechanism. A set of contacts in series with the fingers open if the enclosure cover is opened.

SUMMARY OF THE INVENTION

The principal object of the present invention is to provide a plug-type switch device for monitoring a mechanical condition, such as whether a handwheel type water-flow valve is open, the device being of simple construction which may be manufactured primarily of stock parts.

Briefly summarized, the present invention includes a plug assembly made up of a two-prong male electrical plug whose two connectors are connected by an insulated wire loop whose length is just sufficient to pass through the spokes of the handwheel valve to be supervised. A receptacle assembly has an enclosure with a key-locked cover which houses, wired in series, a female electrical receptacle and a normally closed enclosure cover tamper switch. The receptacle is free to move about within the enclosure, but is normally mated with the male plug through a passage in the enclosure wall. The series combination of the tamper switch and the female receptacle mated to the loop-shorted male plug provides a normally closed switch circuit which opens if the handwheel is turned, the wire loop cut, or the enclosure cover removed. The receptacle is mounted at such distance from the valve that any turning of the handwheel unmates the plug. Once unmated, the receptacle will not remain aligned with the passage to accept reinsertion of the plug; to remate the plug and receptacle to restore the circuit the enclosure cover must be unlocked and removed and the receptacle physically positioned in alignment with the passage.

BRIEF DESCRIPTION OF THE DRAWING

The drawing is an exploded cabinet view of a preferred embodiment of the present improved plug-type switch, shown with the male plug and female receptacle disconnected.

DESCRIPTION OF THE PREFERRED EMBODIMENT

The present invention is a normally closed plug-type switch device which may be utilized to supervise a spoke-type handwheel a of a sprinkler system water-flow valve 6. Alternatively, it may also be used to supervise the tetherable manual actuators of any type of valve or to supervise that any movable object remains in a normal fixed position.

The plug-type switch includes a male plug assembly, generally designated 10, like those used in previous plug-type switches, having a conventional 110 volt male plug 11 with two flat, parallel, prong-type contacts 12. Each contact 12 has a conventional associated hook-up terminal (not shown) by which a flexible loop of waterproof insulated wire conductor 13 connects the two contacts 12, shorting them electrically. The loop 13 passes through the handwheel a to tether the male plug 11 to the handwheel a. The insulation is shown partially broken away to reveal the conductor 14.

The plug-type switch further includes a receptacle assembly, generally designated 20, including an enclosure, generally designated 21, formed with a rectangular metal body 22, which in use of the plug-type switch is mounted to a structural member adjacent to the supervised handwheel a by a mounting bracket 23. The enclosure 21 is of such interior dimensions as to contain a female electrical receptacle, described below, with freedom for movement of the receptacle. The rectangular body 22 has an access opening to its interior, which in this preferred embodiment is made up of the entire open front 24 of the body 22, for the orientation of the body 22 shown in FIG. 1. In a vertical end wall 25 of the body 22 there is provided a circular opening 26, as shown in dashed lines in FIG. 1, providing a passage through which the male plug contacts 12 may be inserted. The lower wall of the body 22 has, at its end opposite the end wall 25 with the circular opening 26, an increased thickness portion 28 having a vertical bore 29, which will accept thinwall conduit c to enclose wiring from the plug-type switch to alarm signalling apparatus. The rectangular body 22 further has a threaded horizontal bore 33 in the inner side of its rear wall. Its open front 24 has at its edges a pair of forward-extending alignment pins 34.

An electrically insulating end panel 36 is secured by screws on the outer side of the end wall 25 having the circular opening 26. The end panel 36 has a pair of parallel slots 37 spaced to accept for insertion therethrough the two flat prong contacts 12 of the male plug 11; the panel 36 insulates the plug contacts 12 from the metal body of the enclosure 21.

The enclosure 21 is provided with a gasket 40 and a metal cover 45 for its interior access open front 24. The cover 45 has a pair of alignment bores 46 which receive the alignment pins 34 of the rectangular body 22. On its inner side, the cover 45 has a central cylindrical housing 47, shown in dashed lines; a bore 48 extends through the cover 45 and housing 47, having a shoulder 49 by which its diameter is decreased on its inner end.

To secure the cover 40 to the body 22, the switch is provided with a lock rod 52 which, when in place, extends through the cover housing bore 48 to the rear wall of the body 22, where it mates with the threaded bore 33 by a threaded inner end 53. At its opposite end, the lock rod 52 has a radial flange 54 to engage the bore shoulder 49; longitudinally outward of the flange 54, the rod has a four-sided key tab 55. A lock key 58, of the skate-key type, is provided to mate with the four-sided key tab 55 of the lock rod 52, which is used to screw the threaded end 53 of the lock rod 52 into the rear wall threaded bore 33, securing the cover 45 to the rectangular body 22.

Inside the enclosure 21, the receptacle assembly 20 is provided with a female electrical receptacle 60, such as used for 110 volt ac, having two internal contacts 61 which may be mated with the contacts 12 of the male plug 11, through the slots 37 in the enclosure end panel 36. Each contact 61 has a conventional associated hook-up terminal (not shown).

Internally, the receptacle assembly 20 is further provided with a precision switch 65, utilized as a tamper switch, being so mounted to the upper wall of the rectangular body 22 that its spring-biased plunger 66 is pushed downward to close the switch 65 when the cover 45 is in place. Thus, the tamper switch 65 is normally closed when the cover 45 is in place and opens if the cover 45 is loosened or removed. The tamper switch 65 and female receptacle 60 are wired in series; the series combination is shown in FIG. 1 connected by wire nuts to external circuit wiring to conventional alarm signalling apparatus of the type which signals upon opening the circuit.

Manufacture of the plug-type switch described above requires only conventional methods of construction. Many off-the-shelf parts may be utilized.

For use of the novel plug-type switch, the receptacle assembly 20 is mounted by its enclosure mounting bracket 23 to a convenient structural support adjacent to a handwheel to be supervised. The location of the receptacle assembly 20 is chosen so that the male plug 11 may be inserted through the slots 37 in the enclosure end panel 36 while the loop of insulated conductor 13 passes through the handwheel a. The loop 13 with its conductor 14 is passed through the handwheel a prior to being finally connected to the hook-up terminals of the male plug 11. The length of the loop 13 is just sufficient that if the handwheel a is rotated, the plug 11 will be pulled from its normal position inserted in the receptacle assembly 20.

To set up the plug-type switch for operation, the handwheel a is rotated to its desired normal position, usually open, the male plug 11 is inserted through the slots 37, and the female receptacle 60 is physically positioned in alignment with and finally mated with the male plug 12; when so mated, some resistance to unmating is provided by the physical connection between the plug 11 and receptacle 60. The series combination of the tamper switch 65 and the female receptacle 60, mated to the shorted male plug 11, provides a normally closed switch circuit. Opening of this switch circuit may then trigger an alarm at an alarm station via the external wiring. To complete set-up of the plug-type switch, the gasket 40 and cover 45 are put in place and the lock rod 52 inserted and screwed into the threaded bore 33 at the rear of the enclosure 21 by the lock key 58; this closes the tamper switch 65.

Once thus set up, the plug-type switch supervises the handwheel a. The normally closed switch circuit is opened if any one of three conditions occurs:

(1) The handwheel a is rotated, pulling the loop 13 and finally disconnecting the male plug 11 from the female receptacle 60, opening the switch circuit.

(2) The loop 13 is cut or otherwise open-circuited; the male plug 11 is no longer shorted and the switch circuit is opened.

(3) The cover 45 is loosened or removed, causing the closed tamper switch 65 to open, opening the switch circuit.

When the plug 11 is disconnected from the receptacle 60, in the embodiment shown the receptacle 60 drops downward to lie on the lower wall of the enclosure 21. The enclosure end wall 25 is of such a depth, below the slotted passage 37, that the receptacle 60 is then out of alignment with the end wall circular opening 26 and slots 37 in the end panel 36. Therefore, reinsertion of the male plug 11 through the slots 37 cannot result in reconnection of the plug 11 and receptacle 60, which are now in alignment.

Another interior dimension factor illustrated prevents remating of the plug and receptacle, even if the end wall 25 is not of such a depth: when the plug prongs 12 are inserted through the slots 37, the prongs 12 will cause the receptacle 60 to be slided away from the end wall 25 rather than mate with the plug 11, because the force required to force the prongs 12 into the receptacle 60 is greater than that required to slide the receptacle 60. This sliding is made possible where, as shown, the interior of the enclosure 21 is of substantially greater length aft of the passage in the end wall 25 than the length of the female receptacle.

A contemplated modification of the above-described apparatus is provision of means to positively bias the receptacle from alignment with the end wall passage, such as a spring mechanism to force the receptacle along the vertical wall away from the passage or to skew the receptacle relative to the passage, upon its unmating from the male plug. In the light of the present disclosure, this modification requires no further illustration.

In any of these cases, remating may only occur by removal of the cover 45 and physical positioning of the receptacle 60 in alignment with the passage while reinserting the male plug 11. By providing a lock key 58 only to persons authorized to open and close the sprinkler system waterflow valves, they are assured to be always kept open.

Should anyone rotate the valve, it will open the plug-type switch to trigger an alarm, notifying authorities that the valve has been disturbed. The alarm is terminated by an authorized person having a key, who reopens the valve and then opens the cover and remates the plug and receptacle.

Modifications of the above described apparatus will be apparent to persons skilled in the art. For example, where it is not likely that the means by which the plug is secured to the manual actuator or other movable object is likely to be cut, the male plug may simply be shorted within, rather than providing a conductor within the loop, and the plug physically secured to the movable object. Though placement of the male plug external to the enclosure and the female receptacle within the enclosure is preferred because no energized contacts may be shorted by the metal enclosure, the plug and receptacle may be reversed, or other types of multi-contact electrical connectors matable with each other may be utilized, with two corresponding contacts of each connector utilized for the switch circuit. For the male plug, one prong may be of greater length than the other, to assure that the female receptacle is slided aft before the shorter plug prong contacts its corresponding receptacle contact. Other means may be utilized to lock the cover in place at the interior access opening. From these examples other modifications will suggest themselves.

I claim:

1. A normally closed alarm switch device for use in supervision, by an alarm system, of the tetherable manual actuators of water valves and the like, comprising a plug assembly including a male electrical plug of the type having at least two contacts, a loop of flexible insulated conductor by which such manual actuator is tethered, the conductor connecting two contacts of the male plug, the alarm switch device further comprising a receptacle assembly including a female electrical receptacle of the type having at least two contacts, each with an associated hook-up terminal, the receptacle being so formed as to mate for electrical connection with the male plug, whereby the mated receptacle and plug assembly forms a closed switch circuit between the receptacle hook-up terminals, the receptacle assembly further including an enclosure of such interior dimensions as to contain the female receptacle with freedom for movement of the receptacle, the enclosure having an access opening to its interior, a cover for the opening, means to lock the cover in place at the opening, and passage means into the enclosure to accept insertion of the male plug contacts therethrough, whereby to mate with the female receptacle contained within the enclosure, whereby movement of such tethered manual actuator draws the loop and unmates the plug and receptacle, opening the switch circuit, and the plug may thereafter be remated with the receptacle only by unlocking and removing the enclosure cover and manually positioning the receptacle in alignment with the passage means while so inserting the male plug contacts through the passage means.

2. The alarm switch device defined in claim 1, and further comprising a tamper switch, mounted within the enclosure and having contacts which are normally closed when the enclosure cover is in place and which open when the cover is off, the tamper switch being in series circuit with the female receptacle, whereby the switch circuit is likewise opened if the enclosure cover is removed.

3. The alarm switch device defined in claim 1, wherein the enclosure interior is of substantially greater length aft of the passage means than the length of the female receptacle, whereby, upon inserting the plug into the passage means without so manually positioning the receptacle, it is slided aft and does not mate with the plug.

4. The alarm switch device defined in claim 1, wherein the enclosure passage means is through a vertical wall of the enclosure, the enclosure interior being of such depth below the passage means that upon unmating of the plug and receptacle, the receptacle drops from alignment with the passage means.

5. The alarm switch device defined in claim 1, and further comprising means to bias the receptacle out of alignment with the passage means upon unmating from the plug.

6. The alarm switch device defined in claim 1, wherein the male plug is of the type having two flat prongs, and wherein the enclosure passage means includes an electrically insulating panel having a pair of slots therethrough which receive the male plug prongs, whereby to both align the plug and insulate its prongs from the enclosure.

7. The alarm switch device defined in claim 1, wherein the means to lock the cover is a key-type lock, whereby only the possessor of the key thereto may remove the cover to close the switch circuit after turning the handwheel.

8. A normally closed alarm switch device for use in supervision whether a movable object remains in a normal fixed position, comprising a plug assembly including a first multi-contact electrical connector, means to electrically short contacts thereof, and means to physically secure the first connector to such a movable object, the alarm switch device further comprising a receptacle assembly including a second multi-contact female electrical connector matable with the first electrical connector and having hook-up terminals associated with the said second connector contacts, and an enclosure of such interior dimensions as to contain the second connector with freedom for its movement therein, the enclosure having an access opening to its interior, a cover for the opening, means to lock the cover in place at the opening, and passage means into the enclosure of such size that the first connector may be mated from outside the enclosure with the second connector within the enclosure through the passage means and thus to form a closed switch circuit between the second connector hook-up terminals, whereby movement of the object from its normal fixed position unmates the connectors, opening the switch circuit, and the connectors may thereafter be remated only by unlocking and removing the enclosure cover and manually positioning and holding the second connector in place.

9. The alarm switch device defined in claim 8, wherein the means to physically secure the first connector to the movable object includes a flexible loop by which the movable object may be tethered, and wherein the means to electrically short contacts of the first connector is a conductor within the flexible loop, whereby the switch circuit is opened if the flexible loop and its conductor within it are cut.

10. A normally closed alarm switch device for use in supervision, by an alarm system, of the tetherable manual actuators of water valves and the like, comprising A. a plug assembly including a male electrical plug of the type having at least two contacts, and a loop of flexible insulated conductor by which such manual actuator is tethered and which electrically connects two contacts of the male plug, and B. a receptacle assembly including (1) an enclosure having an access opening to its interior, a cover for the opening, means to lock the cover in place at the opening, and passage means into the enclosure to accept insertion therethrough of the male plug contacts, the receptacle assembly further including (2) a female electrical receptacle contained and movable within the enclosure and of the type having at least two contacts matable through the enclosure passage means with the male plug contacts, and (3) a normally closed tamper switch in series with the female receptacle to form a switch circuit and so mounted as to open upon removal of the enclosure cover, whereby to signal an alarm upon removal of the enclosure cover, unmating of the plug from the receptacle, or cutting of the loop of conductor.

* * * * *

UNITED STATES PATENT AND TRADEMARK OFFICE

CERTIFICATE OF CORRECTION

PATENT NO. : 4,234,879

DATED : November 18, 1980

INVENTOR(S) : Robert K. Baker

It is certified that error appears in the above—identified patent and that said Letters Patent is hereby corrected as shown below:

In column 3, line 38, after the word "handwheel", insert ---valve---.

In column 4, line 19, after the word "now", insert ---not---.

Signed and Sealed this

*Tenth* Day of *March 1981*

[SEAL]

*Attest:*

RENE D. TEGTMEYER

*Attesting Officer*

*Acting Commissioner of Patents and Trademarks*